US006839977B1

(12) United States Patent
Truckner

(10) Patent No.: US 6,839,977 B1
(45) Date of Patent: Jan. 11, 2005

(54) METHOD AND APPARATUS FOR LOCATING HOLE POSITIONS ON AN ADJUSTABLE STAIR STRINGER

(75) Inventor: Richard Truckner, Hayward, CA (US)

(73) Assignee: E Z Stairs, Inc., Laguna Hills, CA (US)

( * ) Notice: Subject to any disclaimer, the term of this patent is extended or adjusted under 35 U.S.C. 154(b) by 83 days.

(21) Appl. No.: 10/202,340

(22) Filed: Jul. 24, 2002

Related U.S. Application Data

(60) Provisional application No. 60/308,192, filed on Jul. 27, 2001.

(51) Int. Cl.[7] ..... G01B 3/14

(52) U.S. Cl. ..... 33/562; 33/476; 33/481; 33/492

(58) Field of Search ..... 33/562–563, 566, 33/474, 476, 481, 483, 492, 494

(56) References Cited

U.S. PATENT DOCUMENTS 3,863,348 A * 2/1975 Herbst ..... 33/494
4,686,769 A * 8/1987 Rock et al. ..... 33/197
4,819,391 A * 4/1989 Tassin et al. ..... 52/182
4,930,225 A * 6/1990 Phillips ..... 33/526
4,998,355 A * 3/1991 Greene ..... 33/667
5,090,129 A * 2/1992 Cunningham ..... 33/562
5,293,722 A * 3/1994 Reimann ..... 52/182
5,367,783 A * 11/1994 Nygren ..... 33/613
5,615,488 A * 4/1997 Brady ..... 33/484
5,727,325 A * 3/1998 Mussell ..... 33/429
5,806,254 A * 9/1998 Bennett ..... 52/182
6,088,977 A * 7/2000 Lawrence ..... 52/182
6,354,403 B1 * 3/2002 Truckner et al. ..... 182/228.1

* cited by examiner

*Primary Examiner*—G. Bradley Bennett
*Assistant Examiner*—Yaritza Guadalupe
(74) *Attorney, Agent, or Firm*—George W. Wasson

(57) ABSTRACT

A stariway can be constructed by using movable tread/riser supports placed along a stairway stringer and the supports can be moved as a group or individually to accomodate a stairway slope of any desired degree. It is desirable to mark a stringer for the uniform equal spacing of the location for the tread/risers and to establish the pivot positions for mounting the supports on the stringer. The present invention is an apparatus that will permit a user to locate the desired pivot holes equally spaced and aligned along a stringer.

1 Claim, 7 Drawing Sheets

METHOD AND APPARATUS FOR LOCATING HOLE POSITIONS ON AN ADJUSTABLE STAIR STRINGER

This application claims priority from Provisional Patent Application 60/308,192, filed Jul. 27, 2301.

This invention relates to a mechanical means (jig) and a method for locating "adjustable brackets" on a stair stringer by either locating the position of pivot holes or physically locating the position of the brackets thus forming an adjustable stair stringer.

This method of positioning and attaching brackets makes possible the sale of adjustable brackets independent of the stringers. The stringers may be any suitable material for the application of stair building. This invention eliminates the neccessity of supplying complete adjustable stingers (which are very difficult to stock in stores situation). The stringers can simply be assembled on site according to the number of steps required or stringer type (one or two piece).

In the copending application in which I am an inventor Appln. No. 09/315,809, filed May 21, 1999, now U.S. Pat. No. 6,3511,403, issued Mar. 12, 2002, there is disclosure and description of the advantages of building a stairway using adjustable parallel stringers at each side of the stairway and adjustable stair tread/riser brackets pivotally supported on and spaced along the stringers in building a stairway. The concept is to provide, for the experienced or inexperienced builder, a set of duplicate brackets that can be spaced along and pivotally attached to a stringer consisting of a pair of stringer elements that can be moved parallel to each other. As the parallel stringers are moved parallel to each other, the brackets are each rotated about their pivotal attachments so as to have their tread/riser surfaces always parallel to each other and to define the positions of stair steps along the stringers. Because the stringer and bracket system is completely adjustable, the user can form a stairway of any angle or slope and the brackets for the treads or risers will be equally spaced and parallel along the stairway. It should be understood that the stringer and bracket assembly will be at each side of a stairway. The system is also effective in positioning formworks for concrete stairways in positioning the forms for the stair steps equally along the stairway.

SUMMARY OF THE INVENTION

The system is Intended to make the formation of a stairway or set of forms an easy process at the site where the stairway is to be constructed. The user need only establish the slope for the stairway that is to be constructed, align the pair of parallel stringers, and space the brackets equally along the stingers. The user decides what vertical distance and distance between steps is to be used for the desired stairway to establish its slope. Uniform spacing of the brackets along the stringers is essential to accomplish the desired stair construction. Having started with stringer elements that are otherwise unmarked, the user starts by locating the spaced pivot points for the brackets along the stringer. The present invention simplifies the location of the spaced pivot points for, the brackets and provides a means for assuring that the brackets will be equally spaced and, with proper pivotal mounting, movable so as to keep the tread/riser portions always parallel as the stinger is moved to the desired slope.

An object of the present invention is a simplified jig for use in locating the pivot points along a stairway stringer for placement of tread/riser supports along the stringer.

A further object in accord with the preceding objects is a jig that can cooperate with similar jigs and spacing means for locating pivot points for brackets along a stairway stringer.

A further object in accord with the preceding objects is an adjustable jig for locating pivot points for brackets along a stairway stringer.

Further objects and features of the present invention will be readily apparent to those skilled in the art from the appended drawings and specification illustrating a preferred embodiment wherein:

DETAIL DESCRIPTION OF EMBODIMENTS

The present invention comprises an apparatus with indicia or openings spaced along apparatus that can be positioned along the surface of a stringer and, when placed with respect to a desired starting position, the indicia or openings can be used to locate the positions for one or more pivot points for tread/riser brackets. The apparatus includes an alignment means for properly positioning the apparatus along a stinger and for establishing the desired lateral spacing of pivot points with respect to an edge of the stringer. Using the present invention, the builder of a stairway can start with readily available construction materials at the job site for forming the stairway stringer, can mark the stringer for the lateral and axial positioning of pivot points for tread/riser brackets, can mount the desired brackets on the stringer, can place the stringer in the desired location, can pivot the brackets with the placement of the stringer, can fix the brackets in the desired position, and can proceed with the construction of the stairway adding treads and risers. No cutting of stringer slots or calculation of distances between brackets is required; the use of the jig of the present invention provides for equal spacing of brackets about equally spaced pivot hole locations along the stringers.

Figure 1:
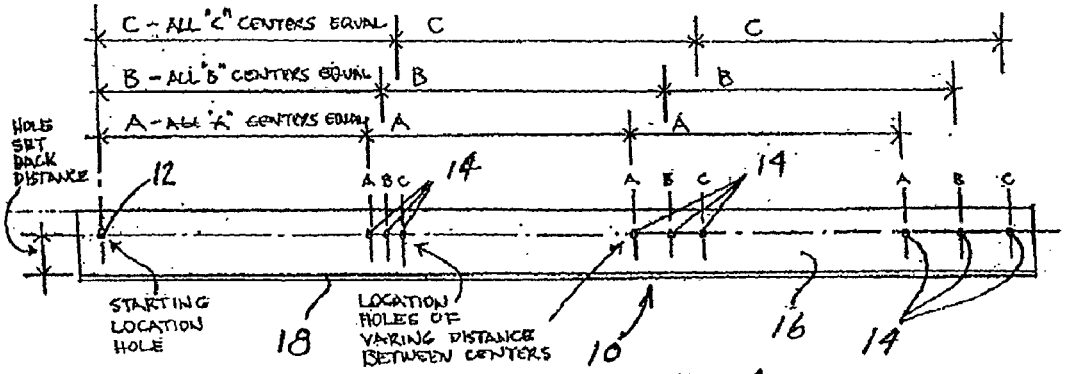
FIG. 1 is top plan view of one form of the apparatus of the present invention showing a plurality of sets of spacing holes.

FIG. 1 shows the pivot hole locating apparatus 10 of the present invention in the form of a jig. FIG. 1 is a plan view of a multiple hole jig 10 with a starting hole 12 and three sets of holes 14 marked A, B and C. In the form of jig illustrated, the spacing of the holes marked A in each set are equally spaced from the preceding hole A; the holes marked 3 in each set are equally spaced from the preceding hole B and a different spacing from that of holes A; and the same applies to holes C. This makes it possible to choose various pivot hole centers by choosing to mark all A, or all B, or all C holes. This will vary the spacing between stair treads but will maintain a uniform spacing between each tread in a stair as illustrated by the distance designations above the apparatus in the drawing. The jig 10 as illustrated is an elongated rigid element having a planar body 16 with a longitudinal edge 18.

Figures 2A, 2B, 2C:
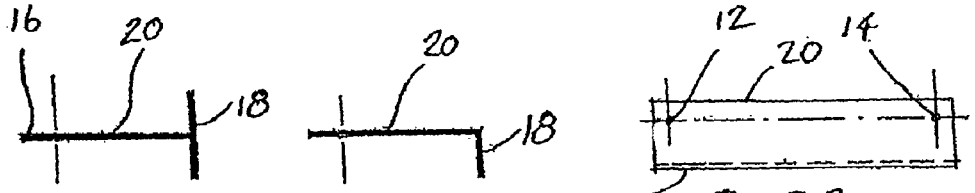
FIGS. 2A and 2B are end views of alternative forms of the apparatus.
FIG. 2C is a plan view of the apparatus with a single set of spacing cutout holes.

FIG. 2A illustrates an end view of one form of the jig 10 where the planar body 16 and the longitudinal edge 18 are in the form of a flange forming a T shaped apparatus. The planar body portion 16 includes a lateral portion 20 where the starting hole 12 and the sets of holes 14 are located. These holes are spaced from the edge 18 a fixed distance for the pivotal mounting of brackets on a stairway stringer.

FIG. 2B illustrates another form for the jig apparatus where only a single lateral portion 18 is provided to form an L shaped jig.

FIG. 2C is a plan view of a jig with only a single starting hole 12 and a single spaced locating hole 14. This form of jig can be used for either side of a stringer to space markings for pivot holes for brackets.

Figure 3:
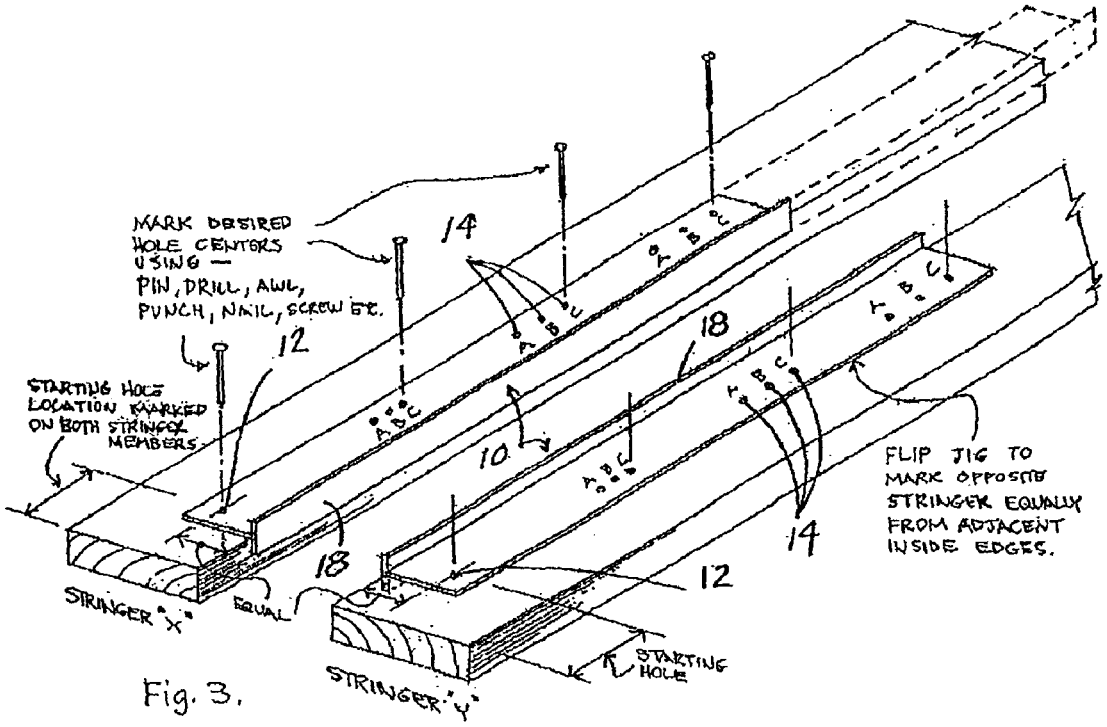
FIG. 3 is a perspective view of parallel stringers with the apparatus of the present invention placed for location of a plurality of equally spaced pivot points along each stringer.

FIG. 3 illustrates in perspective the use of the jig 10 of FIG. 1 in locating pivot hole markings along a pair of stairway stringers. The stringers are designated X and Y and the jig 10 is placed on the surface of the stringers to permit marking for pivot hole locations. As illustrated, the jig 10 is placed on stringer X with the starting hole 12 in a first marked position and with the flange 18 pressed against the edge of the stringer X. The sets of holes 14 are spaced along the jig and, as illustrated, a marker (pin, drill, punch, nail, pencil or the like) is shown in position for being passed through the holes to mark the stringer. In the illustration of FIG. 3, the sets of holes C are the distance to be marked and each mark along the stringer will be equally spaced from its neighbor so that the distance from the starting hole to the first mark at C and the distance between marks C along the stringer will be equal. Shown in dotted lines is the next positioning of the jig for subsequent sets of marks. In repositioning the jig along the stringer, the start hole 12 will be aligned with the last marked spacing hole and the same set of holes will be used to continue the marking.

FIG. 3 also shows the positioning of the jig on the opposite stringer Y for the set of parallel stringers. In the use of the jig for the second stringer, the jig is rotated about its longitudinal axis so that the T shaped jig is aligned to place a starting hole marking through a hole 12 at the same distance from the end of the stinger as that of stringer X and the same set of marking holes is used.

Figure 4:
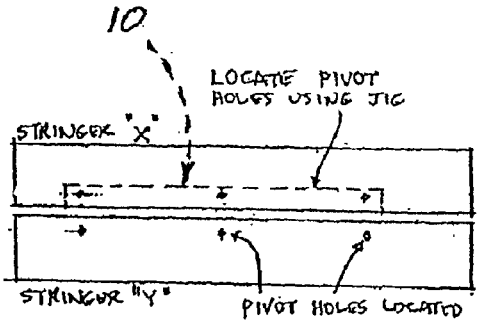
FIG. 4 illustrates the location of spaced pivot points along a set of parallel stringers.
Figure 5:
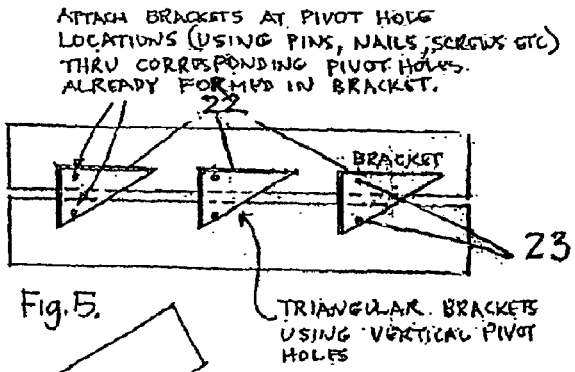
FIG. 5 illustrates the attachment of triangular brackets at the located spaced points of FIG. 4.
Figure 6:
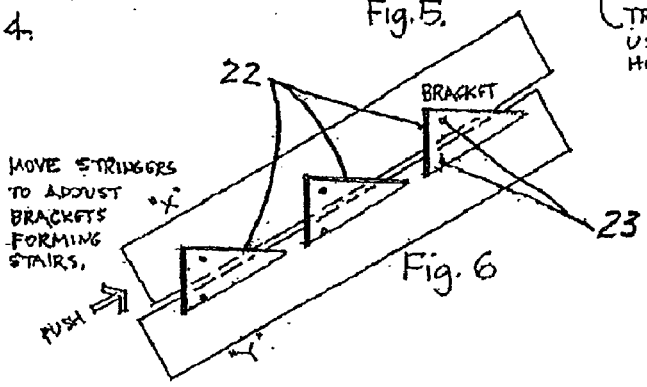
FIG. 6 illustrates the movement of the parallel stringers of FIG. 4 and the resultant rotational movement of the brackets.

FIGS. 4, 5 and 6 illustrate the marking of parallel stringers X and Y, the mounting of pivotal triangular brackets 22, and the movement of the stringers and brackets to place the stinger and brackets in position for the construction of a stairway. The brackets 22 are attached to the stringers X and Y by suitable fasteners 23 (pins, nails, screws or the like) at the holes that were marked on the stringers X and Y using the locating jig 10. It should be understood that once the stringers of FIG. 6 have been moved axially with respect to each other and a duplicate stringer has been placed at the opposite side of the stairway to be built, the brackets 22 are permanently secured to the stringers by the fasteners 23 and additional fasteners if needed and are positioned for the attachment of treads (not shown) at the top of the bracket and risers (not shown) at the face of the bracket.

Figure 7:
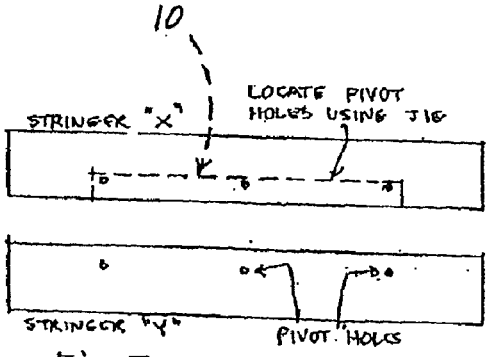
FIGS. 7, 8 and 9 illustrate the location, attachment and rotation of angular brackets similar to the movements shown in FIGS. 4, 5 and 6.
Figure 8:
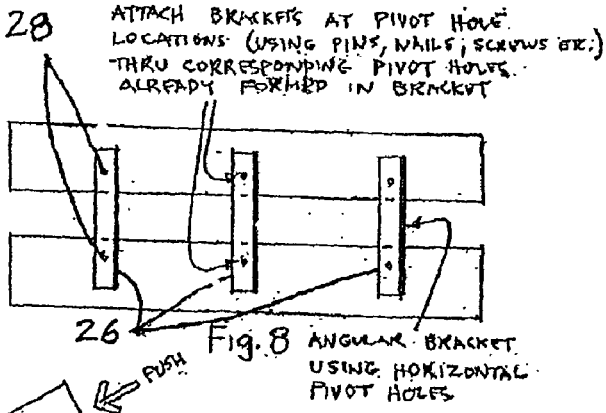
Figure 9:
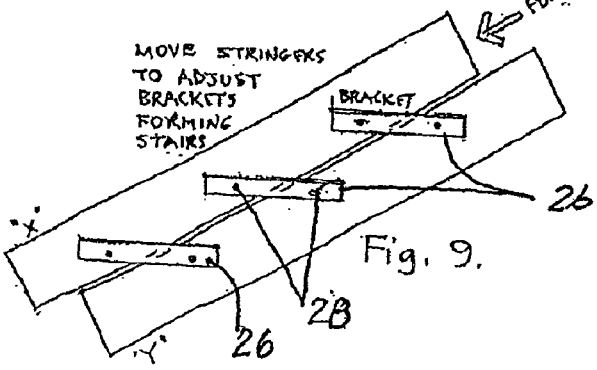

FIGS. 7, 8 and 9 illustrate the marking of parallel stringers and the mounting of pivotal angular brackets 26 with fasteners 28 at the marked positions on the stringers using the jig 10. As in FIGS. 4, 5 and 6, the stringers X and Y are then movable axially with respect to each other to rotate the brackets 26 about the fasteners 28 to position the brackets for further attachment to the stringers and for the installation of treads (not shown) on the upper face of the brackets.

Figure 10A:
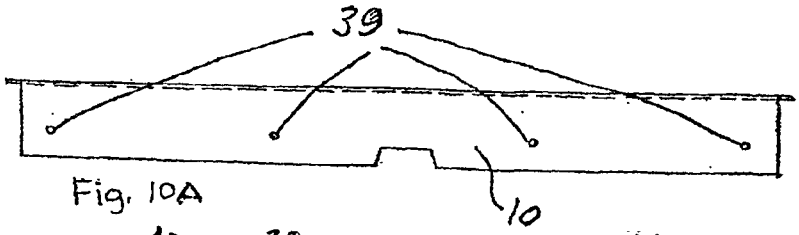
FIGS. 10A, 10B, 11 and 12 illustrate a jig with registering means and its rotational movement with movement of the stringers to which it is attached as a bracket.
Figure 10B:
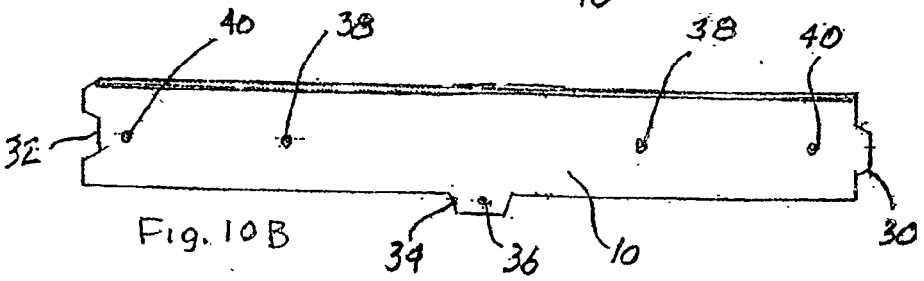
Figure 11:
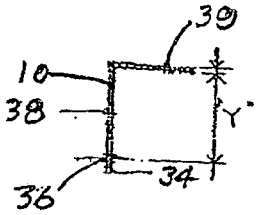

FIGS. 10A, 10B, 11, 12, 13 and 14 illustrate an alternative form for the jig 10 that functions also as an angular bracket for tread mounting. In this form the jig/bracket is provided with registering means for spacing and aligning the jig along a stringer. FIG. 10A is a plan view and FIG. 10B is an elevational view of this alternative form of jig 10; FIG. 11 is an end view of the jig/bracket. As shown in FIG. 10B there are matching complementary registering means in the form of a tab 30 at one end and a slot 32 at the opposite end of the jig 10. The jig also includes a spacing tab 34 with a spacing hole 36 for marking the location for pivot holes along a stringer. The location of pivot holes for brackets are marked along a stringer by passing a marking means through hole 36 in each of the series of jigs 10 placed on the stringer and registered by the mating of tabs 30 and slots 32. The flange portion of the jig Is placed on the edge of the stringer so that the tab 34 and hole 36 are the desired spacing from the edge. Holes 38 are provided for pivotally mounting a bracket on the stringer and additional mounting holes 40 are provided for the eventual fixing of the bracket to the stringers. Holes 39 are provided for the attachment of a tread as will be described.

Figure 13:
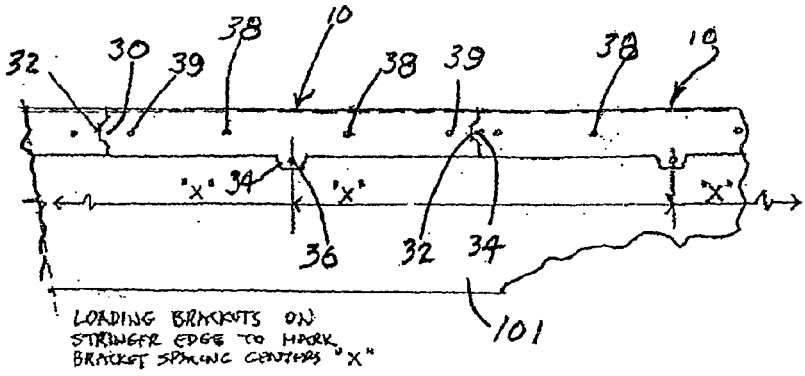
FIG. 13 illustrates the placement of the jig of FIG. 10 along a stairway stringer.

FIG. 13 illustrates the jig/bracket 10 of FIGS. 10A and 10B placed along the surface of a stringer 101 with mating tabs 30 and slots 32 of adjacent jigs engaging each other. Pivot holes are located by marking with suitable means through holes 36. The bracket 10 then can be mounted for pivotal movement on the stringer 101 at those locations with a fastener through hole 38.

Figure 12:
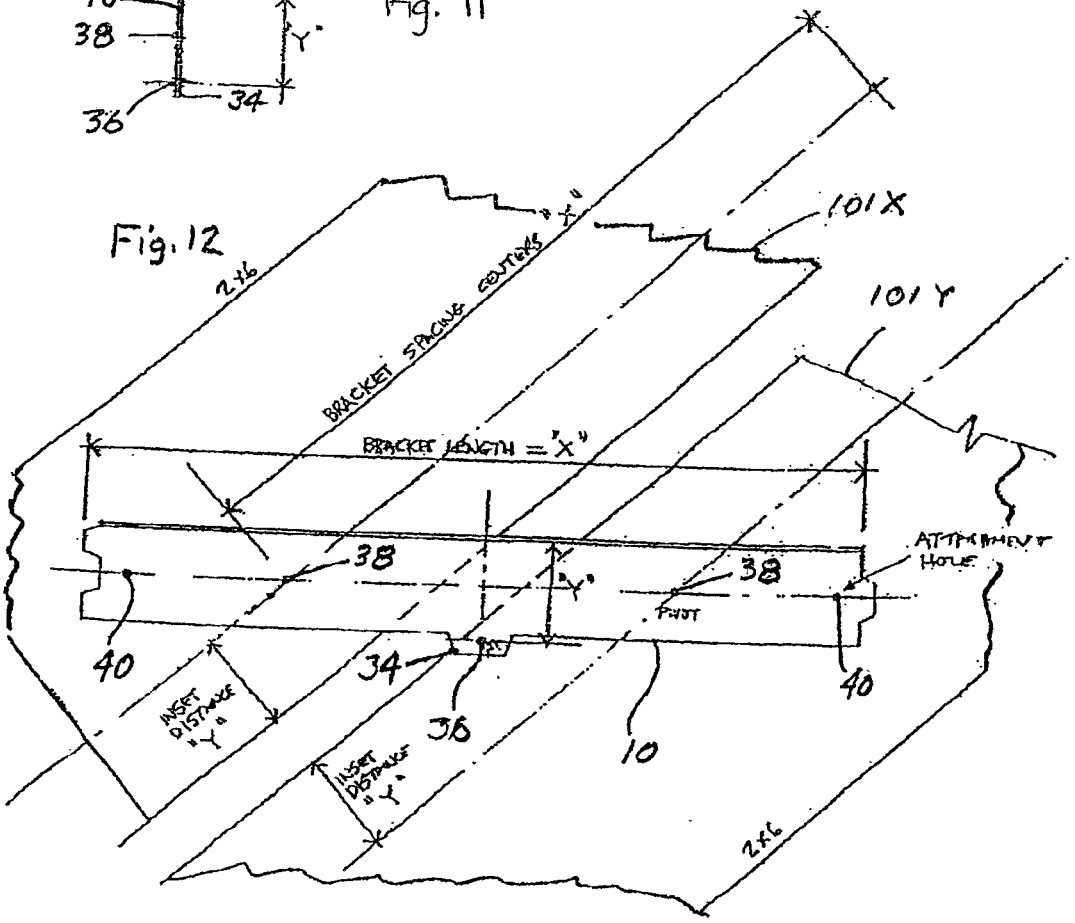
Figure 14:
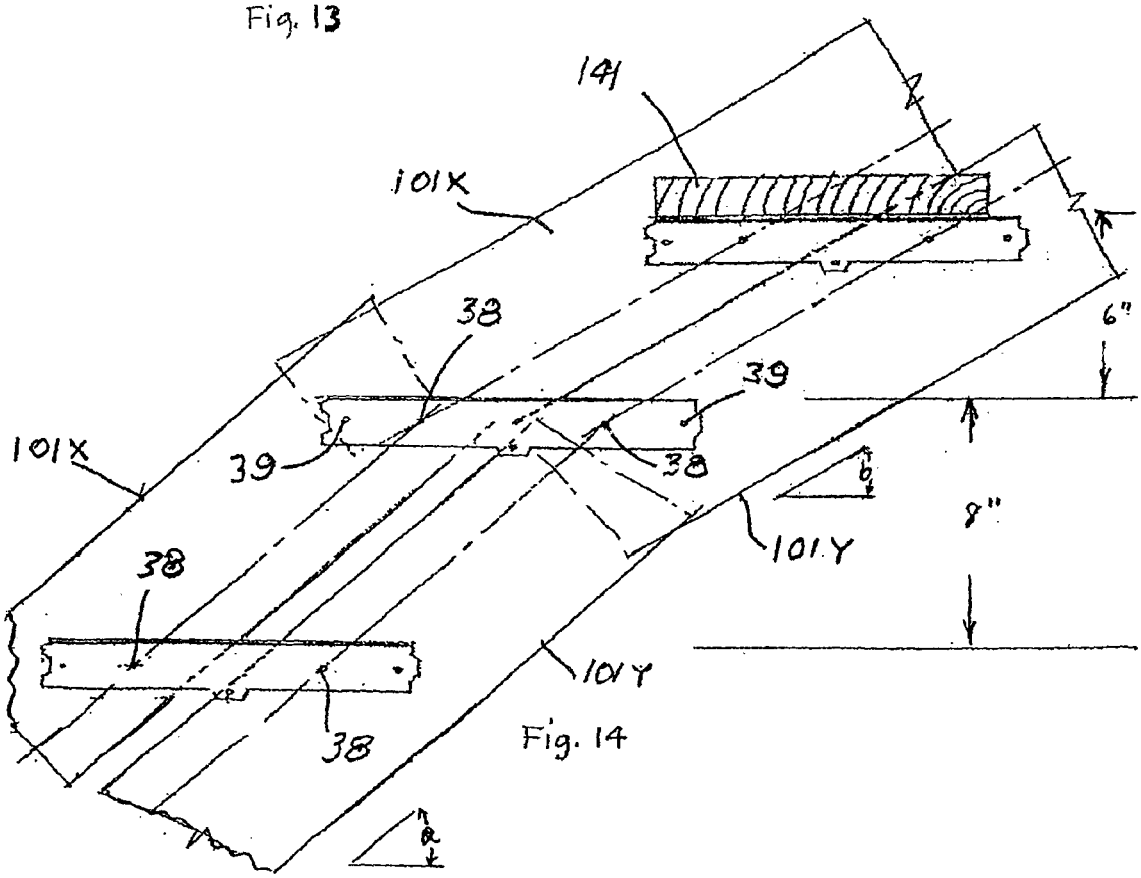
FIG. 14 illustrates the rotational movement of the brackets of FIG. 13 with movement of the parallel stringers and illustrates two different slopes for a stairway.

As shown in FIGS. 12 and 14, the jig 10 can be used as a bracket 10. The jig/bracket 10 is removed from its marking alignment and rotated to place a hole 38 in alignment with the marked location established using hole 36 in the FIG. 13 position. When the bracket is positioned on the stringer and is pivotal about the fastener through hole 38, the bracket is rotatable to a desired position. In the use of parallel stringers as shown in FIGS. 12 and 14, a second fastener is placed through hole 38 in the bracket into the second stringer at the marked location using the jig 10. When the bracket is so located and fastened, the movement of the stringers causes the brackets along the stringers to rotate and remain parallel. As shown in FIG. 14, each bracket is rotatable about its pivot hole attachment with suitable fastening means passing through holes 38 on the bracket so as to mount the bracket on both stringers 101X and 101Y when the stringers are move axially with respect to each other.

FIG. 14 illustrates the ability of the brackets to remain with parallel tread surfaces when the stringers are positioned at different slope angles. The lower part of FIG. 14 is at a slope angle "a " as illustrated by the graphic angle and the upper part of FIG. 14 is at a slope angle "b" as illustrated by its adjacent graphic angle. In the representative showing of FIG. 14, these two slope angles could be the equivalent differences between a step spacing of 8 inches in the lower portion and of 6 inches in the upper portion. In FIG. 14 a tread 141 is shown mounted to the upper surface of the bracket 10.

Figure 15:
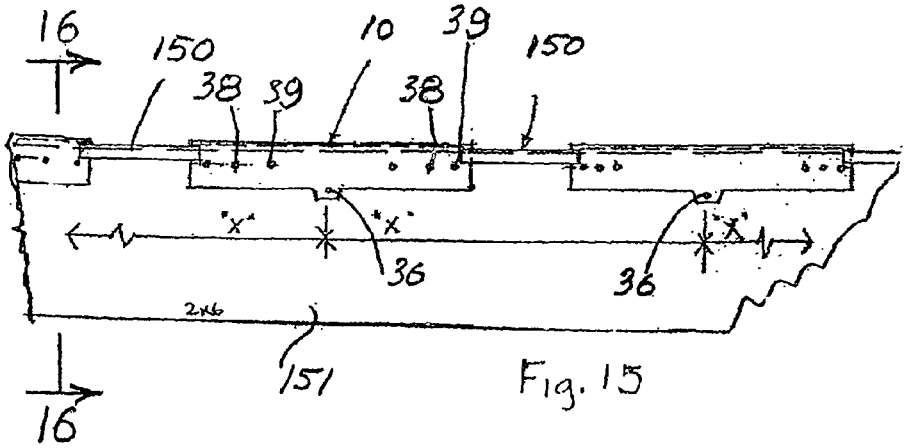
FIG. 15 illustrates a jig adapted for use with spacing means for positioning the jig for location of pivot holes along a stringer.
Figure 16:
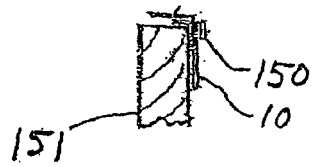
FIG. 16 is a sectional view along the lines 16—16 of FIG. 15.
Figure 17:
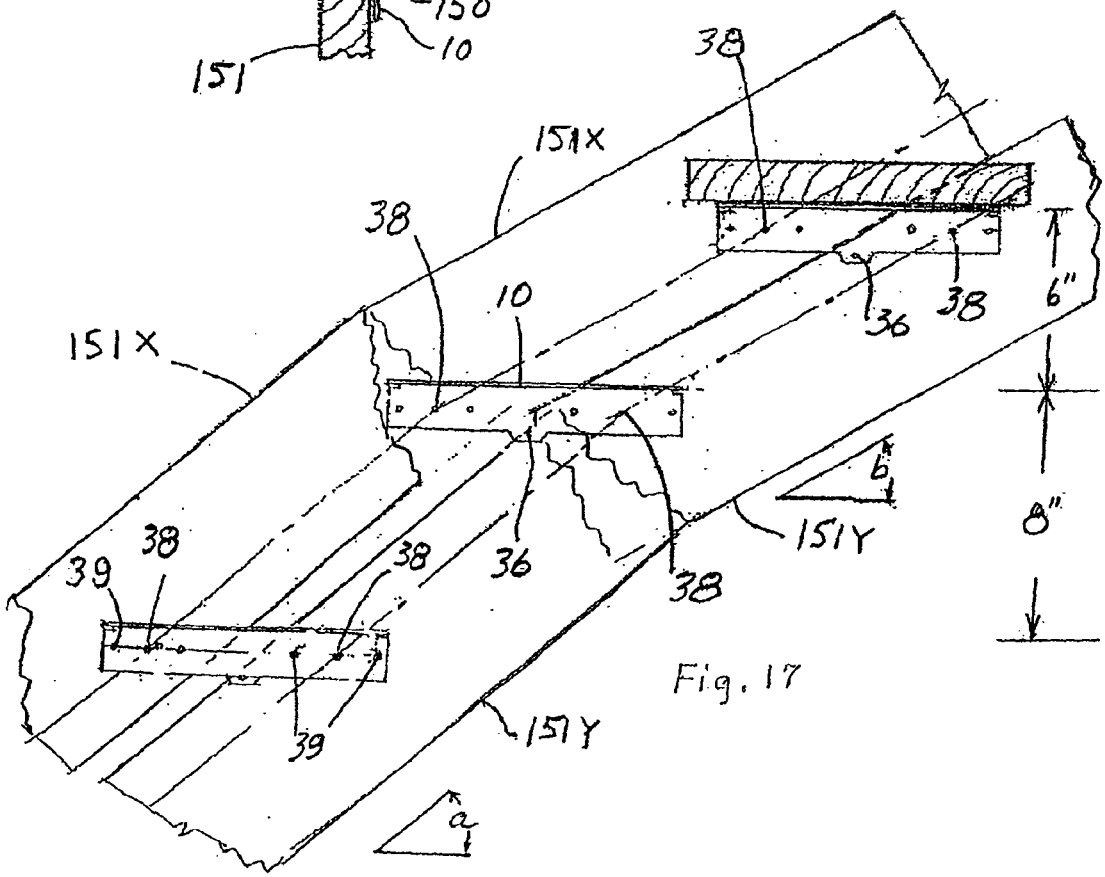
FIG. 17 illustrates the rotational movement of the brackets of FIG. 15 with movement of the parallel stringers and illustrates two different slopes for a stairway.

FIGS. 15, 16 and 17 illustrate another alternative form of a jig/bracket 10 construction. In this form, the jig/bracket 10 is adapted for cooperation with an angular spacer 150. When a jig/bracket 10 is placed along the surface of a stringer 151 and spaced from adjacent jig/brackets at both sides with an angular spacer 150, the marking holes at 36 are used for locating pivot holes for the bracket along the stringer 151. The spacers 150 are removed when the bracket is pivotally attached to the stringer by fasteners through holes 38 with the fasteners at the marked pivot hole locations.

As illustrated in FIG. 17, the brackets 10 are attached to each of parallel stringers and rotated about the fasteners through holes 38 engaging the stringers at the pivot locations. When the stringers 151X and 151Y are moved axially with respect to each other the brackets are rotated to produce the desired parallel tread support surfaces. The angles "a" and "b" are as described with respect to FIG. 14 and the riser difference of 8 inches and 6 inches is shown by the different angles of the stringers. As illustrated, a tread may be attached to the bracket by fasteners through tread and bracket.

FIGS. 18, 19, 20 and 21 illustrate another alternative form for a jig 10 and its use in positioning brackets along a stringer. This form of jig can be used to position either triangular brackets like those shown in FIG. 6 or angular brackets like those shown in FIG. 9. The jig 10 as illustrated includes a planar body 16, a longitudinal edge 18, and a lateral portion 20. At the edge of the lateral portion 20 of the jig away from the longitudinal edge 18, a series of equally spaced slots 181 are cut into the lateral portion.

Figure 18:
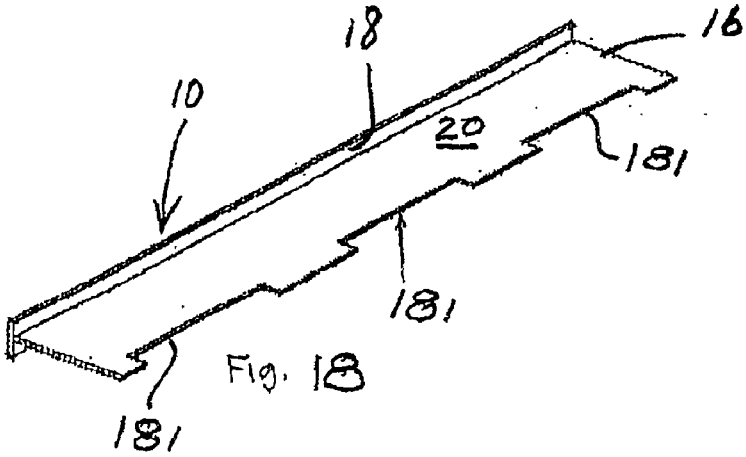
FIG. 18 illustrates an alternative form for the apparatus of the present invention.
Figure 19:
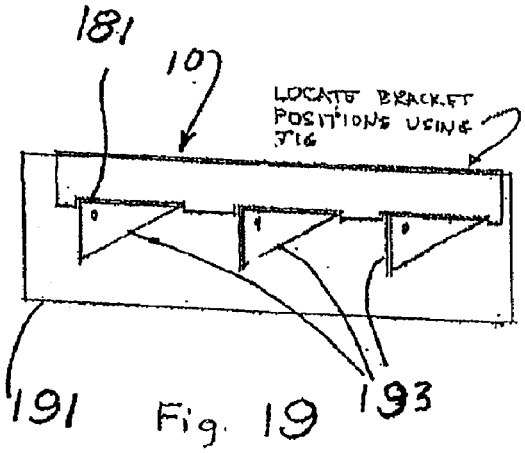
FIGS. 19, 20 and 21 illustrate the use of the apparatus of FIG. 18 in the placement of triangular brackets along a stringer and the rotation of the brackets on the stringer.
Figure 20:
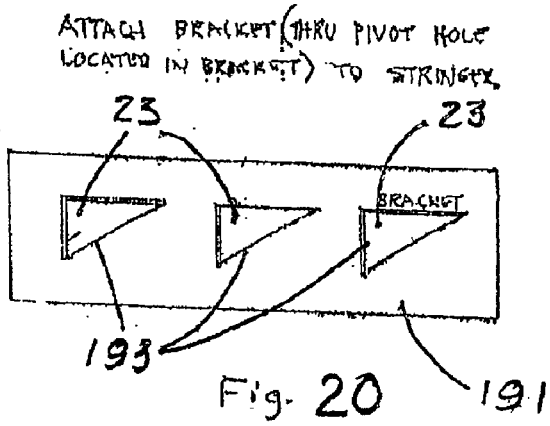
Figure 21:
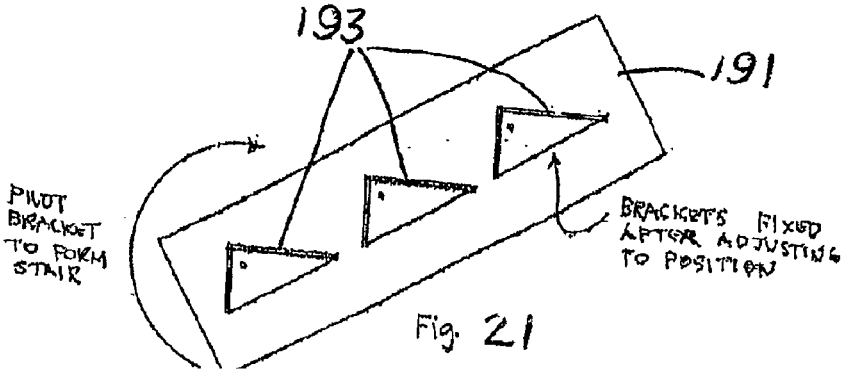

The FIG. 18 jig 10 is adapted to be placed along the surface of a stringer 191, as shown in FIG. 19, for the location of a series of brackets 193 along the stringer. The brackets can then be attached by suitable fasteners 23 through pivot holes in the bracket. The brackets 193 are then equally spaced along the stringer 191 and are equally spaced from the edge of the stringer by the spacing of the slots 181 along the lateral portion 20 of the jig 10. It should be apparent that the triangular or angular brackets used in forming a stairway can be positioned by the use of this jig. As illustrated in FIGS. 19, 20 and 21 the jig is shown as used in a one piece stringer and the brackets 193 are illustrated with a single pivotal attachment; it should be understood that the jig of FIG. 18 can be used with the parallel stringers as shown in previous Figs. and that attaching the brackets to the parallel stringers with two pivot points will permit the brackets to be rotated to a desired angle as the stringers are positioned for construction of a stairway.

Figure 22:
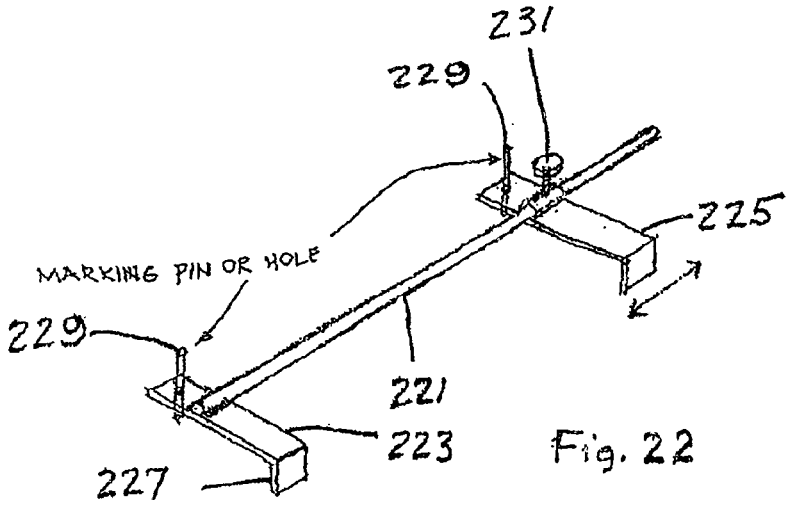
FIG. 22 illustrates an alternative adjustable form of the apparatus of the present invention for locating pivot holes for brackets along a stairway stringer.

FIG. 22 illustrates a further modification of apparatus of the present invention for locating pivot holes along a stairway stringer for the placement of pivotal tread/riser supports. In this form, a jig 10 includes a spacing bar 221 with a fixed marker member 223 attached to the bar 221 and an adjustable marker member 225 movable along the bar 221. Both the fixed and the adjustable marker members include an edge 227 and a marking means in the form of a hole or pin 229. The attachment of the fixed marker member 223 to the spacing bar 221 and the adjustable marker member 225 to the spacing bar is a set distance from the edge 227. The adjustable marker member 225 is attached to the spacing bar 221 by a slideable connection with a suitable locking means shown as a set screw 231.

When the jig of FIG. 22 is used for locating pivot holes along a stairway stringer, the jig is first adjusted in spacing along the spacing bar for the desired spacing between tread/risers in the stairway and the adjustable marker member 225 is locked in place by setting the set screw 231. The jig is then placed on the stringer with the edges 227 against an edge of a stringer and the fixed or adjustable marker member is set at the desired starting point. The marking means 229 are then used to mark the stringer for the location of the desired spaced pivot holes. That procedure is repeated along the stringer for the additional tread/riser brackets that are to be used. If parallel stringers are to be used, the marking of pivot holes continues for the second of the stringers. If a single stringer is used, only one set of marking holes is needed. The attachment of a bracket, either triangular or angular, can then proceed in the form illustrated in the preceeding drawings.

Figure 23:
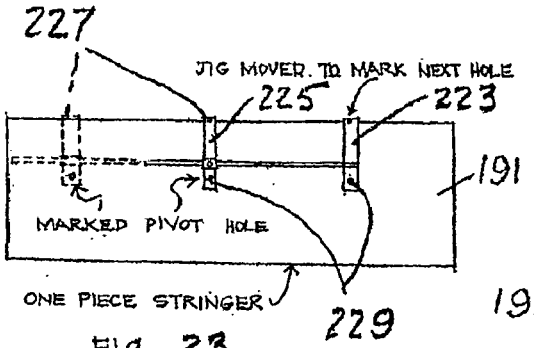
FIG. 23 illustrates the use of the adjustable apparatus of FIG. 22 on a stairway stringer.
Figure 24:
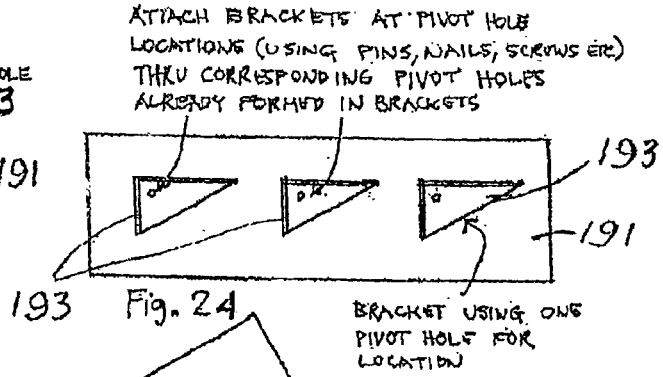
FIGS. 24 and 25 illustrate the placement of triangular brackets along a stringer and the rotation of the brackets on the stringer.
Figure 25:
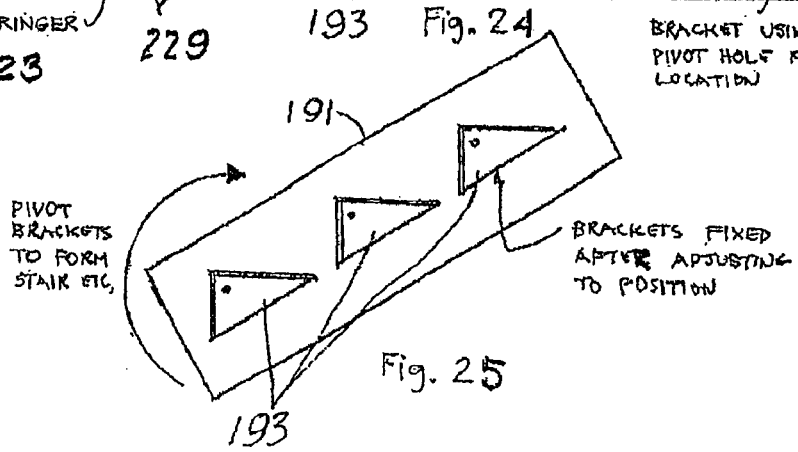

FIG. 23 illustrates the positioning of the jig of FIG. 22 on an edge of a stringer In position for marking the location of pivot holes for the mounting of brackets along the stringer.

The foregoing description is illustrative of the form that the jig may take in locating pivot holes for placement of tread/riser supports along a stairway stringer. In some of the illustrations the jig is also shown in its possible use as a bracket for the support of treads or risers. The invention as claimed is the apparatus for assisting the stairway builder in spacing tread/riser support brackets and the pivot points for those brackets along a one piece stringer or a stringer made of parallel stringers. The apparatus can take several forms as represented by those shown herein.

While certain preferred embodiments of the inventin have been specifically disclosed, it should be understood that the invention is not limited thereo as many variations will be readily apparent to those skilled in the art and the inventin is to be give its broadest possible interpertation within the terms of the following claims.

I claim:

1. An apparatus for locating pivot holes along a stairway stringer for placement of pivotal tread/riser supports consisting of, a) an elongated rigid element forming a two surface planar body portion with a longitudinal edge as one surface and a lateral portion as a second surface, said longitudinal edge being a flange from said rigid element, b) said one surface of sold elongated rigid element planar body portion includes a first means for locating sold planar body portion along a stairway stringer, and said second surface comprising means axially along said planar body portion for locating said pivot holes for tread/riser supports along said stairway stringer, c) said longitudinal edge of said rigid element forms a T shaped flange with portions of said T extending from said longitudinal edge and to each side of said longitudinal edge, d) means in said elongated rigid element for locating the placement of pivotal holes in a stairway stringer, said means being located in said rigid element laterally across said lateral portion and axially along said planar body e) said means in said elongated rigid element for locating the placement of said pivot holes includes i) at least one starting cutout hole located literally across sold planar body and spaced a lateral distance from said longitudinal edge, and ii) a plurality of sets of spacing cutout holes, said sets being aligned with said starting cutout hole axially along said planar body and spaced the same lateral distance from said longitudinal edge as said starting cutout hole, each of said plurality of sets including individual equally spaced cutout holes, each set of individual equally spaced cutout holes consisting of spaced cutout holes spaced a different equal longitudinal distance along said planar body from sold at least one starting cutout hole, whereby a set of spacing cutout holes comprises a plurality of equally spaced cutout holes axially along said planar body, each set of equally spaced cutout holes having a different axial distance between cutout holes from other sets of spacing cutout holes, and iii) each cutout hole in a set being equally spaced from its adjacent cutout holes in that set.

* * * * *

UNITED STATES PATENT AND TRADEMARK OFFICE

CERTIFICATE OF CORRECTION

PATENT NO. : 6,839,977 B1
APPLICATION NO. : 10/202340
DATED : January 11, 2005
INVENTOR(S) : Richard Truckner It is certified that error appears in the above-identified patent and that said Letters Patent is hereby corrected as shown below:

IN THE CLAIMS
Col 6, line 67, "sold" should be --said--
Col 7, line 16, "literally" should be --laterally--
line 17, "sold" should be "said"
Col 8, line 9, "sold" should be --said--

Signed and Sealed this

Ninth Day of January, 2007

JON W. DUDAS
*Director of the United States Patent and Trademark Office*